US008359964B2

(12) United States Patent
Pfersmann

(10) Patent No.: US 8,359,964 B2
(45) Date of Patent: Jan. 29, 2013

(54) WEAPON SYSTEM WITH CASELESS AMMUNITION

(75) Inventor: Axel Pfersmann, Feucht (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 176 days.

(21) Appl. No.: 12/995,334

(22) PCT Filed: May 26, 2009

(86) PCT No.: PCT/EP2009/003697
§ 371 (c)(1),
(2), (4) Date: Nov. 30, 2010

(87) PCT Pub. No.: WO2009/146809
PCT Pub. Date: Dec. 10, 2009

(65) Prior Publication Data

US 2011/0083548 A1 Apr. 14, 2011

(30) Foreign Application Priority Data

May 30, 2008 (DE) ..... 10 2008 026 205
May 13, 2009 (DE) ..... 10 2009 021 191

(51) Int. Cl.
*F41A 9/06* (2006.01)

(52) U.S. Cl. ..... 89/33.03

(58) Field of Classification Search ..... 89/33.03, 89/33.05
See application file for complete search history.

(56) References Cited

U.S. PATENT DOCUMENTS 3,474,560 A 10/1969 Ramsay
3,760,683 A 9/1973 Seemann
4,282,813 A * 8/1981 Sterbutzel ..... 102/431
4,457,209 A * 7/1984 Scheurich et al. ..... 89/45
7,513,185 B1 4/2009 Könicke
2007/0056461 A1 3/2007 Konicke

FOREIGN PATENT DOCUMENTS

DE 1 578 101 B1 4/1975
DE 1578101 B1 4/1975
DE 41 29 763 A1 * 4/1992 ..... 89/45
EP 1 764 576 A1 3/2007
EP 1731867 B1 11/2007
GB 1248784 A 10/1971

* cited by examiner

*Primary Examiner* — Stephen M Johnson
(74) *Attorney, Agent, or Firm* — Laurence A. Greenberg; Werner H. Stemer; Ralph E. Locher

(57) ABSTRACT

A weapon system uses caseless munitions. In order to permit a further use of the weapon system essentially without delay on jamming, a configuration of the weapon system is disclosed that has a weapon barrel, a projectile magazine with individual chambers and a propellant charge magazine with individual chambers. In order to guarantee a firing position, the projectile magazine and the propellant charge magazine, may be moved relative to the weapon barrel. The projectile magazine has a chamber located in a discharge position in which an ejector device for the projectile in the chamber may be activated. A further chamber of the projectile magazine may be loaded in the movement position for the projectile magazine and the propellant charge magazine has a chamber, located in a discharge position in which an ejector device for the propellant charge in the chamber may be activated. The further chamber of the propellant charge magazine may be loaded in the movement position of the propellant charge magazine.

15 Claims, 11 Drawing Sheets

WEAPON SYSTEM WITH CASELESS AMMUNITION

BACKGROUND OF THE INVENTION

Field of the Invention

The invention relates to a weapon system with caseless ammunition, according to the precharacterizing clause of claim 1 and of claim 11.

A system such as this is known, for example, from EP 1 731 867 B1. The projectile and the propellant charge are in this case associated with a respective separate projectile holder and propellant charge holder which, in the firing position, are aligned coaxially with respect to the bore axis of the weapon barrel.

DE PS 15 78 101 discloses the projectile holder and the propellant charge holder being shifted, rotated or swiveled in opposite senses with respect to one another transversely with respect to the weapon barrel, in order to allow a higher firing rate and to keep the heat absorption of the barrel as low as possible. In contrast to the situation with traditional ammunition which has a casing, in which the projectile is firmly connected to the casing which contains the propellant charge, it is not possible to automatically eject the propellant charge as well as the projectile if the propellant charge fails to fire. Therefore, until now, weapon systems with caseless ammunition have had the disadvantage in the event of loading jams that such jams lead to interruptions in operation.

BRIEF SUMMARY OF THE INVENTION

One object of the present invention is to develop the weapon system such that the weapon system can still be used without significant adverse time effects even in the event of loading jams.

This object is achieved by a weapon system for caseless ammunition. The weapon system contains a weapon barrel having a bore axis, a projectile holder having individual chambers, and a propellant charge holder having individual chambers. The projectile holder and the propellant charge holder can be moved relative to the weapon barrel to ensure a firing position in which a respective one of the chambers in the projectile holder and a respective one of the chambers in the propellant charge holder are located coaxially with respect to the bore axis of the weapon barrel. A first ejection device is provided for the projection holder. The projectile holder can be moved such that one of the chambers of the projectile holder is disposed in an unloading position in which the first ejection device can be activated for a projectile in the one chamber while, in contrast, another of the chambers of the projectile holder can be reloaded in a movement position of the projectile holder. A second ejection device is provided for the propellant charge holder. The propellant charge holder can be moved such that one of the chambers of the propellant charge holder is disposed in an unloading position in which the second ejection device can be activated for a propellant charge in the one chamber of the propellant charge holder while, in contrast, another of the chambers of the propellant charge holder can be reloaded in a movement position of the propellant charge holder.

In this case, at a specific time, the projectile holder has a chamber which is located in an unloading position in which an ejection device can be activated for the projectile in the chamber while, in contrast, a further chamber in the projectile holder can be reloaded in particular in this movement position of the projectile holder. At a specific time, the propellant charge holder has a chamber which is located in an unloading position, in which an ejection device can be activated for the propellant charge in the chamber while, in contrast, the further chamber in the propellant charge holder can be reloaded in particular in this movement position of the propellant charge holder. This allows the relevant chamber to be unloaded and the further chamber in the projectile holder to be loaded, and corresponding actions also preferably to be carried out at the same time on the propellant charge holder, to be precise irrespective of whether the relevant chamber is or is not filled with a propellant charge that has failed to fire. The invention makes it possible to dispense with an additional cycle step, that is to say an additional position of the holders for the operation of the ejection devices, and to increase the firing rate even in the event of a failure to fire. The measure according to the invention at the same time allows a simple design configuration.

The ejection device for the propellant charge holder, and preferably that for the projectile holder, is/are preferably activated autonomously, that is to say automatically, in every unloading position, that is to say as the cycle progresses.

The invention can be implemented in a simple manner by the projectile holder and the propellant charge holder each being rotatable about separate axes X and Y, respectively, which are diametrically opposite one another with respect to the bore axis A of the weapon barrel.

The axes X, Y as well as the bore axis A preferably lie on a common plane, which runs in the firing direction.

The idea according to the invention advantageously in each case requires at least two chambers. Correspondingly, the propellant charge holder expediently has at least two chambers and the projectile holder has at least two chambers. For relatively small caliber weapons, for example a 10 mm cannon, an embodiment with only two chambers in each case is particularly advantageous, in terms of the dimensions and the technical implementation.

The system cycle depends on the number of chambers. In the case of a two-chamber system, each cycle corresponds to a quarter of a revolution. The firing position is assumed after every second cycle.

The unloading of the propellant charge holder, that is to say the removal of a propellant charge which may be present having failed to fire, and the loading of the projectile holder preferably take place in opposite senses. In this case, the two holders are rotated with an opposite rotational movement. This is advantageous for specific heat dissipation measures. However, movement in the same sense is also possible.

The projectile is expediently ejected in the opposite direction to the firing direction, toward the loading side. There is therefore no need to overcome the resistance of stops or guide bands associated with the projectile, during ejection.

In contrast, the propellant charge which has failed to fire is preferably ejected in the firing direction, such that this does not cause damage to the rear-end seal.

The activation of the ejection devices can expediently be controlled as a function of the rotational movement of the projectile holder and propellant charge holder, for example via suitable synchronization transmissions or other control means, such as guides or the like.

The invention furthermore expediently provides that a projectile to be unloaded can be moved back into a loading area for the projectiles during the respective unloading process from the projectile holder and, if required, can be ejected from there, out of the loading area, by means of a suitable device.

The ejection device for the projectile and the ejection device for the propellant charge are expediently ejection pins which are each appropriately positioned and can be moved axially. Ejection pins such as these can be coupled to the rotational movement of the projectile holder and of the propellant charge holder via suitable synchronization means, a synchronization transmission or the like. They therefore represent a simple design solution variant.

A further object of the present invention is to develop a weapon system according to the precharacterizing clause of claim 11 so as to ensure the safety and reliability of the weapon system even after lengthy firing sequences.

This object is achieved by a weapon system for caseless ammunition. The weapon system contains a weapon barrel having a bore axis, a projectile holder having individual chambers, and a propellant charge holder having individual chambers. The projectile holder and the propellant charge holder can be moved relative to the weapon barrel for ensuring a firing position in which one of the chambers of the projectile holder and one of the chambers of the propellant charge holder are disposed coaxially with respect to the bore axis of the weapon barrel. A first ejection device is provided for the projection holder and a second ejection device is provided for the propellant charge holder. Insertion devices are provided including a first insertion device and a second insertion device. The projectile holder can be moved in at least one successive cycle. The cycle contains the following successive positions: a first position, in which one of the chambers of the projectile holder is disposed in a loading position, in which the first insertion device can be activated in order to insert a projectile into the chamber of the projectile holder. A second position, in which the chamber of the projectile holder is disposed in the firing position; and a third position, in which the chamber of the projectile holder is disposed in an unloading position, in which the first ejection device can be activated in order to eject the projectile, which may still be located in the chamber of the projectile holder, out of the chamber of the projectile holder. The propellant charge holder can be moved in at least one successive cycle, wherein the cycle contains the following successive positions: a first position, in which one of the chambers of the propellant charge holder is disposed in a loading position, in which the second insertion device can be activated in order to insert a propellant charge into the chamber of the propellant charge holder. A second position, in which the chamber of the propellant charge holder is disposed in the firing position; and a third position, in which the chamber of the propellant charge holder is disposed in an unloading position, in which the second ejection device can be activated in order to eject the propellant charge, which may still be located in the chamber of the propellant charge holder, out of the chamber of the propellant charge holder.

The conventional weapon system for caseless ammunition contains a weapon barrel, a projectile holder which has individual chambers, and a propellant charge holder which has individual chambers, wherein the projectile holder and the propellant charge holder can be moved relative to the weapon barrel in order to ensure a firing position in which one of the chambers in the projectile holder and one of the chambers in the propellant charge holder are located coaxially with respect to the bore axis of the weapon barrel. By way of example, a weapon system such as this can be operated in a single-shot mode. This is the situation in the case of a pistol or a rifle. In this case, the propellant charge is introduced into the firing chamber even before the trigger is operated, for example by manual operation of a loading apparatus (for example a slide). This means that the propellant charge is positioned in the firing chamber for a relatively long time before the shot is actually fired.

Furthermore, in the event of a failure to fire, the propellant charge still remains in the firing chamber until it is manually unloaded. If the propellant charge remains in the firing chamber for a long time (both before firing and after a failure to fire), this can represent a safety problem, in particular once a relatively long firing sequence has already taken place. Specifically, if the firing chamber has already been heated to a major extent by shots which have already previously been fired, there is a risk of the propellant charge which is located in the firing chamber being detonated automatically, without any intention to fire. One or more shots can therefore be fired inadvertently, and this can lead to major accidents. A similar problem occurs when the weapon system is used in the rapid-fire mode. This is the situation, for example, in the case of an automatic pistol or an automatic rifle. In this case, although the propellant charge is not fed to the firing chamber until the trigger is operated and the firing bolt is initiated shortly after this, in the event of a failure to fire, however, the propellant charge still remains in the firing chamber even in the rapid-fire mode. After a long firing sequence resulting in the firing chamber being heated up, there is also a risk in this case in the event of a failure to fire of a propellant charge being inadvertently fired autonomously if it remains in the firing chamber for a relatively long time.

In particular, the invention results in a major improvement to the safety of the weapon system according to the invention, in respect of the self-firing problem described above. The projectile holder can accordingly be moved in one or more successive cycles, wherein each of the cycles comprises the successive positions: a first position, in which one of the chambers in the projectile holder is located in a loading position, in which an insertion device can be activated in order to insert a projectile into this chamber, a second position, in which this chamber in the projectile holder is located in the firing position, and a third position, in which this chamber in the projectile holder is located in an unloading position, in which an ejection device can be activated in order to eject the projectile, which may still be located in this chamber, out of this chamber. Furthermore, the propellant charge holder can be moved in one or more successive cycles, with each of the cycles comprising the successive positions: a first position, in which one of the chambers (for example 5) in the propellant charge holder (4) is located in a loading position (FIGS. 4A, 4B, 4C, 5A, 5B, 5C and 1), in which an insertion device (9) can be activated in order to insert a propellant charge (7) into this chamber (5), a second position, in which this chamber (5) in the propellant charge holder (4) is located in the firing position (FIGS. 4F, 4G, 5F, 5G and 3), and a third position, in which this chamber (5) in the propellant charge holder (4) is located in an unloading position (FIGS. 4J, 4K, 4L, 5J, 5K, 5L and 2), in which an ejection device (10) can be activated in order to eject the propellant charge (7), which may still be located in this chamber (5), out of this chamber (5).

A weapon system designed in this way advantageously ensures that each cycle, which starts with the loading of a chamber in the projectile holder and a chamber in the propellant charge holder, is always carried out completely as far as the unloading in particular of the chamber of the propellant charge holder, to be precise irrespective of when (particularly in the case of an automatic weapon) the trigger is released, and also irrespective of whether, in particular, the most recently loaded propellant charge has or has not failed to fire. This makes it possible to ensure that a propellant charge which is introduced into a chamber in the propellant charge holder (and therefore into the firing chamber) at a specific time remains in the firing chamber for only a very short time period, in all cases. Specifically, either when loaded propellant charge is intentionally fired a short time later in the firing position or if the propellant charge fails to fire or in the event of an interruption in the firing sequence, it is ejected from its propellant charge chamber. This makes it possible to prevent, with a high probability, inadvertent firing of a propellant charge in all feasible cases, even when the propellant charge holder has been heated. This results in a major improvement to the safety of the conventional weapon system.

The projectile holder is preferably borne such that it can rotate about an associated axis. Furthermore, the propellant charge holder is also preferably borne such that it can rotate about an associated axis. The two axes about which the projectile holder and the propellant charge holder are in each case preferably borne such that they can rotate are in each case arranged offset parallel to the bore axis of the weapon barrel. This rotatable bearing of the projectile holder and of the propellant charge holder results in inertia advantages in particular in respect of the alternative of a linear movement capability of the projectile holder and of the propellant charge holder. In the case of a rotatable bearing, the weapon system does not need to operate against the inertia moment of the projectile holder and of the propellant charge holder, as soon as the bearings are rotating. This advantage is not achieved when the projectile holder and the propellant charge holder can be moved backwards and forwards linearly.

Externally driven synchronization means are preferably provided, by means of which the respective ejection device can be operated as a function of the rotational movement and/or the angular position of the projectile holder and/or of the propellant charge holder. In the case of weapon systems, an external drive means the characteristic that mechanical processes in the weapon system take place independently of the forces created when a shot is fired. This is in contrast to so-called self-driven weapon systems, in which the forces which are created on firing are used, for example, for the process of loading the next cartridge. Conventional self-driven weapon systems are, for example, pressure-operated loaders or recoil-operated loaders. As a result of the external drive to the ejection device, in particular of the propellant charge holder, the propellant charge which may still be located in the chamber is ejected from the chamber automatically after the trigger has been released, without any need for any forces from a firing process for this ejection process, as well. This is particularly advantageous when the most recently loaded propellant charge, which is still in place before the trigger is released, fails and can no longer be unloaded because there are now no firing forces. The externally driven synchronization means in this case always still operate the ejection device of the propellant charge holder. The externally driven synchronization means also preferably ensure that no new cycle is commenced after this completion of the last cycle, as a result of which no new propellant charge and no new projectile is inserted into one of the chambers in the propellant charge holder and the projectile holder.

According to one particularly preferred embodiment of the weapon system according to the invention, the ejection devices can be operated with a time offset with respect to the insertion devices, such that the ejection devices always enter the chambers only with a time offset with respect to the insertion of the insertion devices after rotation of the projectile holder and/or of the propellant charge holder through 360°/n from the loading position, that is to say the n-th part of 360°, into the unloading position, where n is the number of chambers in the projectile holder and/or the number of chambers in the propellant charge holder. This time-offset operability of the ejection devices is preferably achieved by the ejection devices and the insertion devices being coupled to one another such that a movement of the insertion devices toward the projectile holder and the propellant charge holder is linked to a movement, preferably of the same magnitude, of the ejection devices away from the projectile holder and the propellant charge holder. Preferably, in a corresponding manner, a movement of the insertion devices away from the projectile holder and the propellant charge holder is linked to a movement, preferably of the same magnitude, of the ejection devices toward the projectile holder and the propellant charge holder. In this case, the projectile holder and the propellant charge holder are preferably arranged between the insertion devices and the ejection devices. This advantageously ensures that the charges which have failed to fire can be ejected/pushed out in the opposite direction to the insertion direction.

This time-offset operation of the ejection devices can be controlled by the synchronization means described above. The advantage of the time offset in the operation of the ejection devices and the coupling of the ejection devices and of the insertion devices is the simple controllability of the loading and unloading process, without any disturbances. Furthermore, the weapon system designed in this way is characterized by quiet operation.

In general, it is advantageous to use as many chambers in the propellant charge holder as possible, since the energy introduced (at the same firing rate, that is to say with the same number of shots fired per unit time) into the propellant charge holder decreases the more chambers that are provided. However, it is disadvantageous that the time for which the respective propellant charges remain in their chambers when using a large number of propellant charge chambers becomes longer the greater the number of chambers that there are. If the propellant charges remain for a long time in the propellant charge holder, this increases the risk of self-ignition (cook-off). The invention therefore confronts the problem of two opposing tendencies, on the one hand to provide as many propellant charge chambers as possible in order to heat the propellant charge holder as little as possible, and on the other hand to provide as few propellant charge chambers as possible in order to keep the time for which the individual propellant charges remain in their chambers as short as possible. For the purposes of the present invention, the knowledge has been obtained from extensive studies of a theoretical and experimental nature that the optimum number n of chambers in the propellant charge holder is equal to 2 (n=2). This situation (n=2) therefore results in the ejection devices entering the chambers with a time offset after rotation of the projectile holder and/or of the propellant charge holder from the loading position through 180° to the unloading position. A further advantage of the provision of the weapon system according to the invention with only two propellant charge chambers and only two projectile chambers is that, with this configuration, it is easier to achieve the advantageous rotation of the projectile holder and of the propellant charge holder in opposite directions, since rotation through 180° in the clockwise direction from the loading position, both for the projectile holder and for the propellant charge holder, leads to the same unloading position and to the same position of the projectile chambers and of the propellant charge chambers with respect to one another as rotation from the loading position through 180° in the counterclockwise direction. For this reason, in the situation in which the number n of chambers is greater than 2, it is in fact advantageous for the projectile holder and the propellant charge holder to rotate in the same sense. However, it is also feasible for the projectile holder and the propellant charge holder to rotate in the same sense when n=2.

One expedient refinement of the present invention will be explained in more detail with reference to the drawing figures.

In the drawings, the same or similar reference signs denote the same or similar parts. In the figures:

DESCRIPTION OF THE INVENTION

Figure 1A:
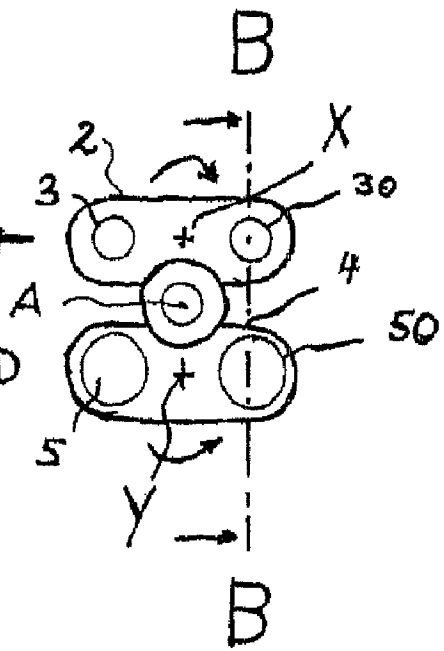
FIG. 1 shows a highly simplified schematic illustration of the loading process of one expedient refinement of the invention in the form of a partial section from the front (FIG. 1A), along the section line B-B in FIG. 1A (FIG. 1B) and along the section line C-D in FIG. 1B (FIG. 1C)
Figure 1B:
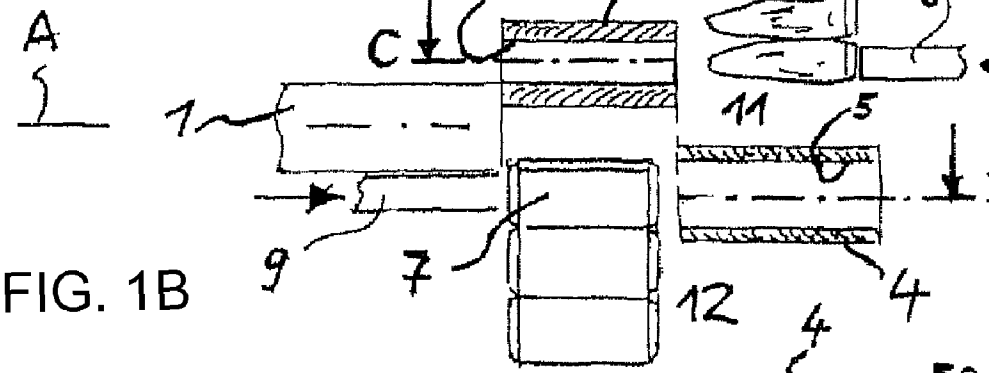

The reference number 1 denotes the weapon barrel, for example for a 20 mm high firing-rate cannon for a weapon system which can preferably be operated automatically with caseless ammunition and with a high firing rate, for example for use in a tank, a helicopter or the like. The weapon system contains a projectile holder 2, which has a total of two chambers 3, 30, for holding projectiles 6 which are located in a magazine or loading area 11. A ram 8 is used to move the projectile 6, which is positioned precisely in the insertion position, for example as illustrated in FIG. 1B, into the chamber 30 in the projectile holder 2. A plurality of projectiles are kept in the loading area 11 and can be moved by means of a feed device (not illustrated) to the insertion position for the next chamber, for example 3. In the cycle illustrated in FIG. 2, the chamber 3 is located in the unloading position.

Furthermore, the weapon system has an autonomous propellant charge holder 4, likewise with two chambers 5, 50, into each of which a propellant charge 7 can be inserted. As can be seen from FIG. 1B, a ram 9, which is located on the firing direction side, ensures that the propellant charge holder 4 is loaded. The supply of propellant charges 7 located in the loading area 12 is moved successively to the insertion position and is fed to the respective chamber (in FIG. 1B, the chamber 50) in the propellant charge holder 4.

Both the propellant charge holder 4 and the projectile holder 2 are in the form of rotating holders and, for example, are moved in opposite senses. As shown in FIG. 1A, the propellant charge holder 4 is moved in the counterclockwise direction about the rotation axis Y, and the projectile holder 2 is moved in the clockwise direction about the rotation axis X. As can be seen from FIG. 1A, the chamber 5 is currently filled with a propellant charge 7 in the rotation position (clock position) illustrated in this figure, while the chamber 30 in the projectile holder 2 is filled with the projectile 6.

The weapon barrel 1 is located in the center. In this rotation position, neither a chamber in the projectile holder 2 nor a chamber in the propellant charge holder 4 is aligned with the bore axis A of the weapon barrel 1.

Figure 1C:
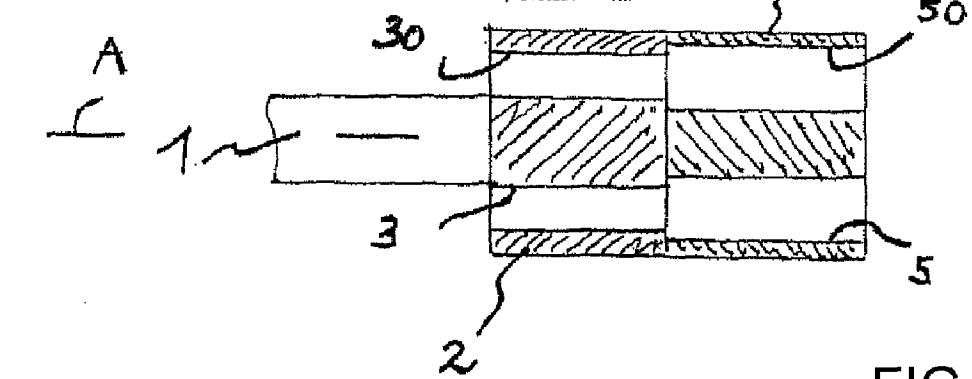

FIG. 1C shows the arrangement of the chambers which are in each case not in the firing position, specifically the chambers 3, 30 in the projectile holder 2 as well as the chambers 5, 50 in the propellant charge holder 4, relative to the weapon barrel 1.

The rotational movement of the projectile holder 2 and of the propellant charge holder 4 takes place through a quarter of a revolution. As is illustrated in FIG. 2, the projectile 6, which may have remained in the chamber 3 as a result of a firing jam, is preferably ejected in the opposite direction to the firing direction in the same rotation position by means of a first ejection pin 13, preferably back from the projectile holder 2 into the loading area 11, where it is segregated by a device (which is not illustrated).

At the same time, the possibly defective propellant charge 7 is preferably ejected by the second ejection pin 10 in the firing direction out of the chamber 50 in the propellant charge holder 4, preferably into the loading area 12, where it is segregated by a device (which is likewise not illustrated).

Figure 2A:
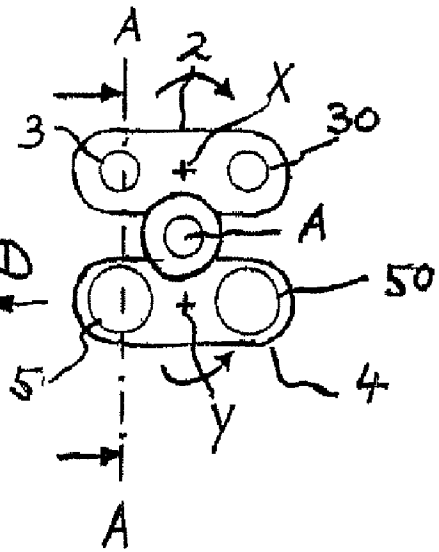
FIG. 2 shows a highly simplified schematic illustration of the unloading process for the above refinement of the invention in the form of a partial section from the front (FIG. 2A), along the section line B-B in FIG. 2A (FIG. 2B) and along the section line C-D in FIG. 2B (FIG. 2C)
Figure 2B:
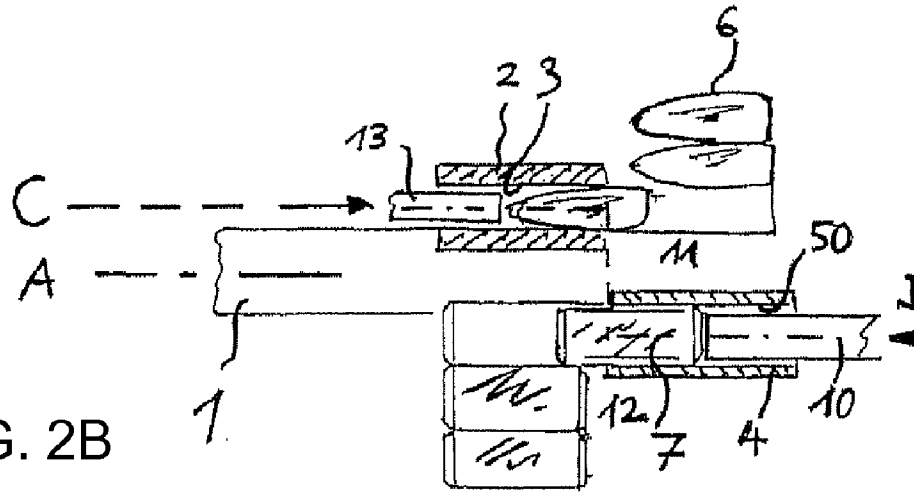
Figure 2C:
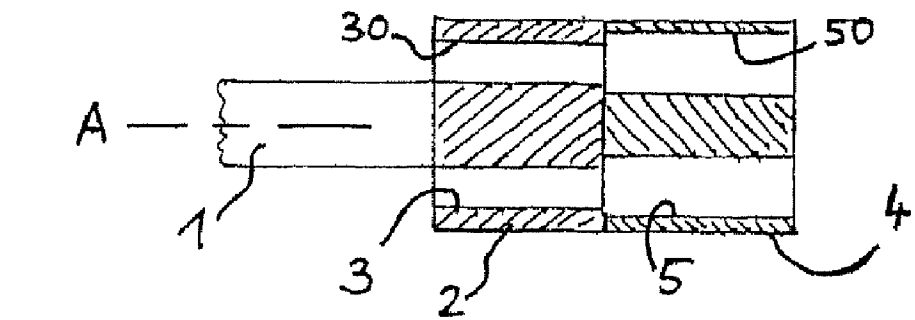

The loading process shown in FIG. 1 and the unloading process shown in FIG. 2 are carried out after every second clock cycle, such that the ejection pins 10, 13 are moved into the relevant chambers irrespective of whether there is or is not a projectile 6 or a propellant charge 7 in the relevant chamber.

Figure 3:
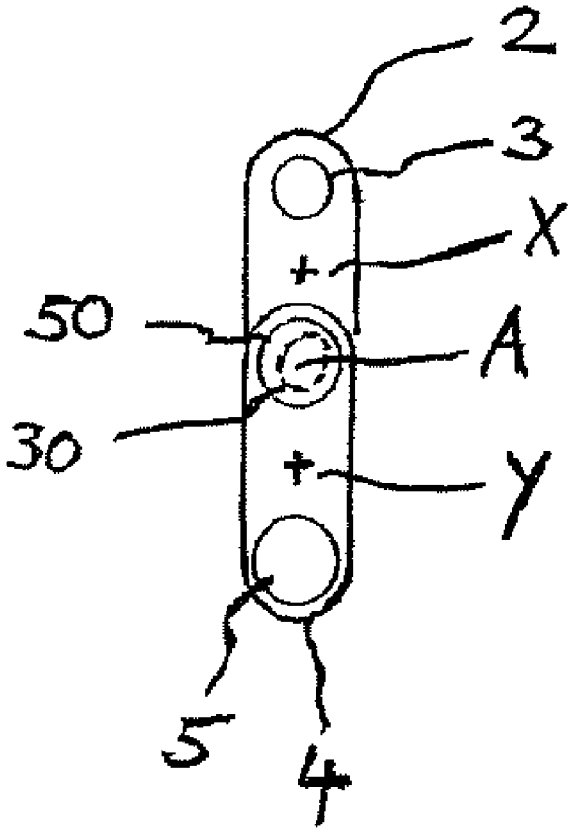
FIG. 3 shows a highly simplified schematic illustration of the firing position.

After the loading and unloading processes shown in FIGS. 1 and 2, respectively, the projectile holder 2 and the propellant charge holder 4 are rotated further through a quarter of a revolution to the position illustrated in FIG. 3 (firing position), in which the previously loaded chambers 30 and 50 are aligned with the bore axis A of the weapon barrel 1.

In this firing position, the previously loaded chambers 30 and 50 are therefore located coaxially with respect to the bore axis of the weapon barrel 1 or, in other words, the chambers 30 and 50 are aligned with the weapon barrel 1.

The ejection pins 10, 13 can be controlled by synchronization means 15 and/or coupling means 14, which operate to the respective ejection pins 10 and 13 as a function of the rotational movement and/or the angular position.

First of all, FIGS. 4A to 4L show a plurality of successive instances in time in one preferred embodiment of the weapon system according to the invention, in order to illustrate the functional process during an undisturbed cycle (without the propellant charge failing to fire). FIGS. 5A to 5L then show a plurality of successive instances in time in the preferred embodiment already illustrated in FIG. 4 of the weapon system according to the invention. FIG. 5 is intended to illustrate the functional process during a disturbed cycle (in which a propellant charge fails to fire).

The functional processes illustrated in FIGS. 4 and 5 each illustrate one complete cycle, which comprises the three positions "loading position", "firing position" and "unloading position". The operation of the weapon system according to the invention therefore represents an undefined sequence of cycles as shown in FIGS. 4 and/or 5.

In the same way as in FIGS. 1 to 3, the reference number 1 denotes a weapon barrel of a weapon system which can preferably be operated automatically with caseless ammunition, and with a high firing rate. The weapon system contains a projectile holder 2, which preferably comprises two chambers 3, 30, for holding projectiles 6 which are located in a magazine or loading area 11. An insertion device 8 is used to move the projectile 6 that has been positioned in the insertion position into the chamber 3 in the projectile holder 2 (see FIGS. 4A to 4C as well as FIGS. 5A to 5C). A plurality of projectiles 6 are kept in the loading area 11, and can be moved by means of a feed device (which is not illustrated) to the insertion position for the next chamber, for example 30.

The weapon system furthermore has a propellant charge holder 4 with a number of chambers 5, 50, into each of which a propellant charge 7 can be inserted. The number of chambers 5, 50 in the propellant charge holder 4 preferably corresponds to the number of chambers 3, 30 in the projectile holder 2. In the present example in FIGS. 4 and 5, the number of chambers 5, 50 in the propellant charge holder 4 is correspondingly equal to 2. The loading of the propellant charge holder 4 is ensured via an insertion device 9. The propellant charges 7 which are kept in the loading area 12 are moved successively to the insertion position and are fed to the respective chamber (in FIGS. 4A to 4C and in FIGS. 5A to 5C, the chamber 5) in the propellant charge holder 4. Both the propellant charge holder 4 and the projectile holder 2 are in the form of rotating holders, which preferably rotate in opposite senses. The opposite rotation of the propellant charge holder 4 and projectile holder 2 allows the weapon system to be operated very smoothly. The reason for the improved smoothness is the mutual compensation of any unbalances in the propellant charge holder 4 and the projectile holder 2, and the mutual compensation for bearing forces which act on the rotating bearings of the propellant charge holder 4 and of the projectile holder 2. As can be seen from FIG. 4A, the propellant charge holder 4 is borne such that it can rotate about the rotation axis Y, and the projectile holder 2 is borne such that it can rotate about the rotation axis X. The two axes X, Y are each arranged offset parallel to the bore axis A of the weapon barrel 1. The propellant charge holder 4 and the projectile holder 2 are arranged between the rear end of the weapon barrel 1 and the firing bolt device 77. The firing bolt device 77 has a firing bolt 777.

Figure 4A:
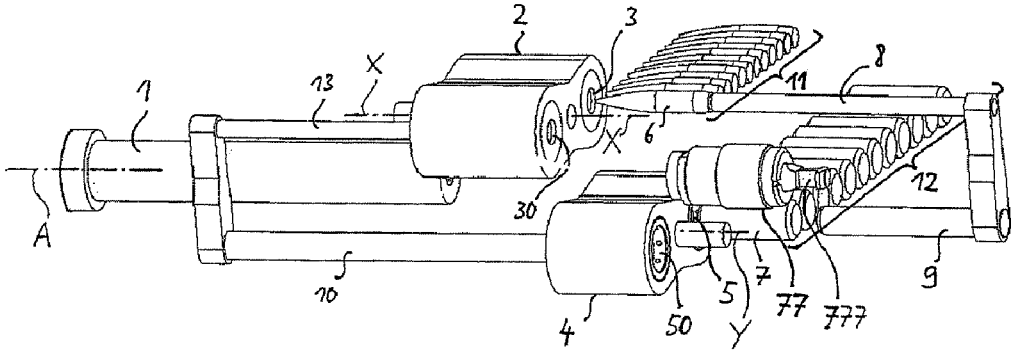
FIGS. 4A-4L show a plurality of successive instantaneous instances in time of one preferred embodiment of the weapon system according to the invention, in order to illustrate the functional process during an undisturbed cycle (without any failures to fire)
Figure 4B:
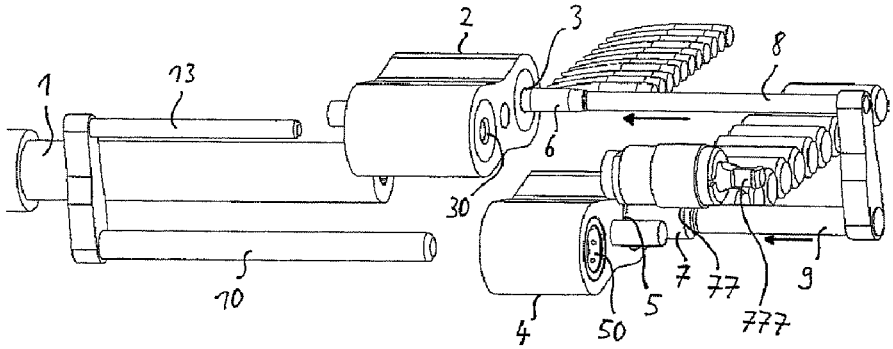
Figure 4C:
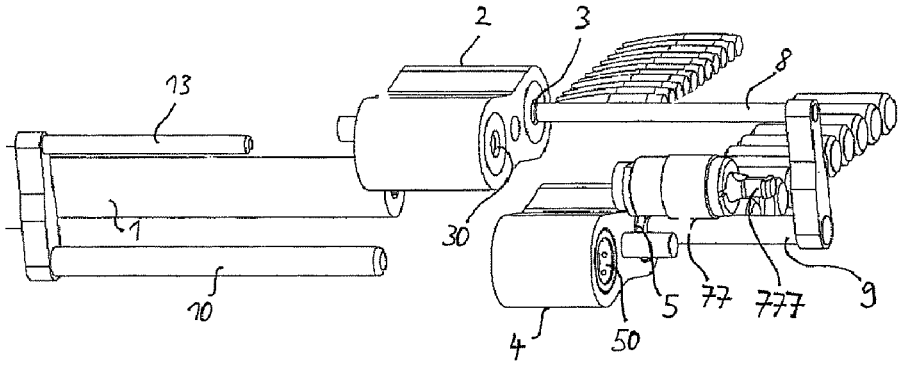

The normal functional process of the preferred embodiment of the weapon system will now be explained with reference to FIGS. 4A to 4L. FIGS. 4A to 4C illustrate a first phase of the cycle, in which the chamber 3 in the projectile holder 2 is located in a first position, specifically in a loading position. In this first position, the insertion device 8 can be activated in order to insert a projectile 6 into this chamber 3. Furthermore, in this first position, the chamber 5 in the propellant charge holder 4 is in the loading position, in which an insertion device 9 can be activated in order to insert a propellant charge 7 into this chamber 5. FIGS. 4A to 4C show these two insertion processes for the projectile 6 and the propellant charge 7. In this case, the insertion device 8 for insertion of the projectile 6 into the chamber 3, and the insertion device 9 for insertion of the propellant charge 7 into the chamber 5, can be coupled to one another. This, preferably rigid, coupling between the two insertion devices 8, 9 makes it possible to ensure that the projectile 6 and the propellant charge 7 are inserted synchronously, in a simple manner.

Figure 4D:
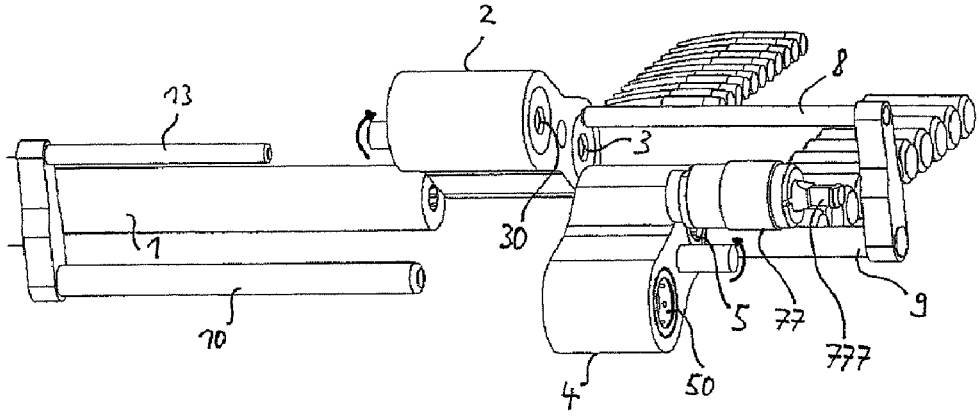
Figure 4E:
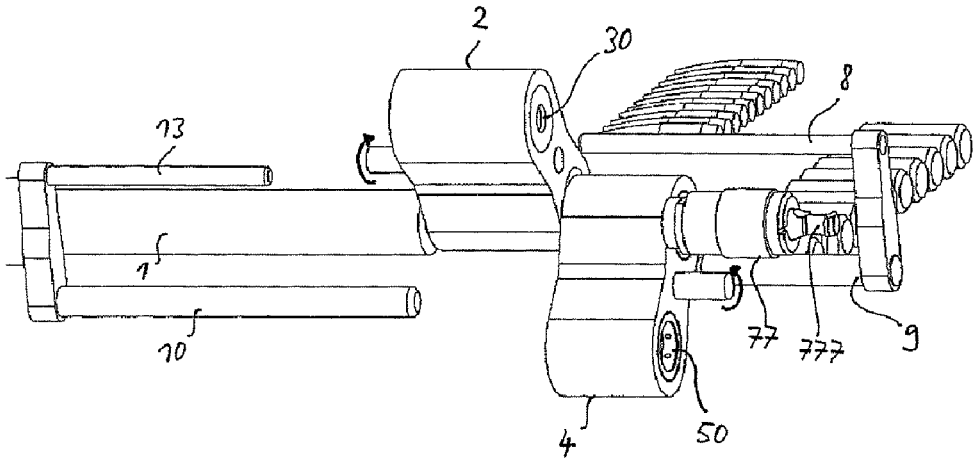
Figure 4F:
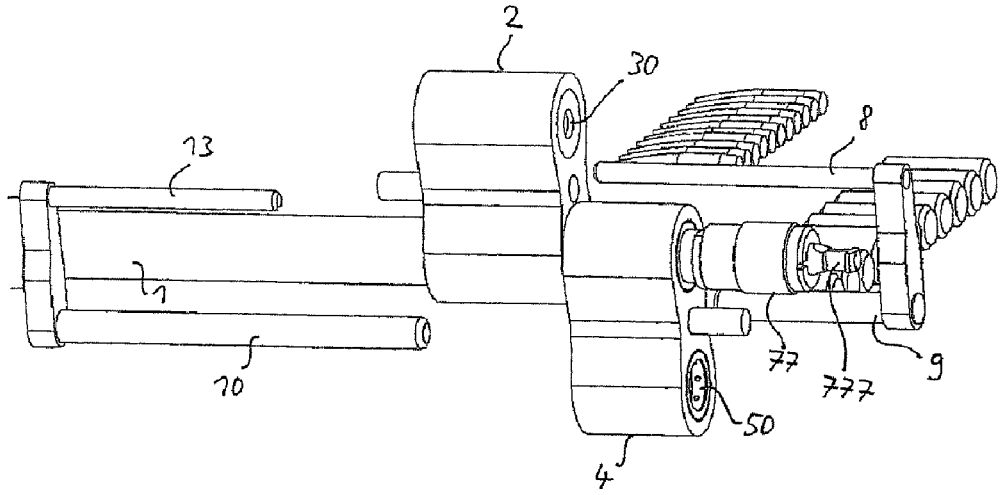
Figure 4G:
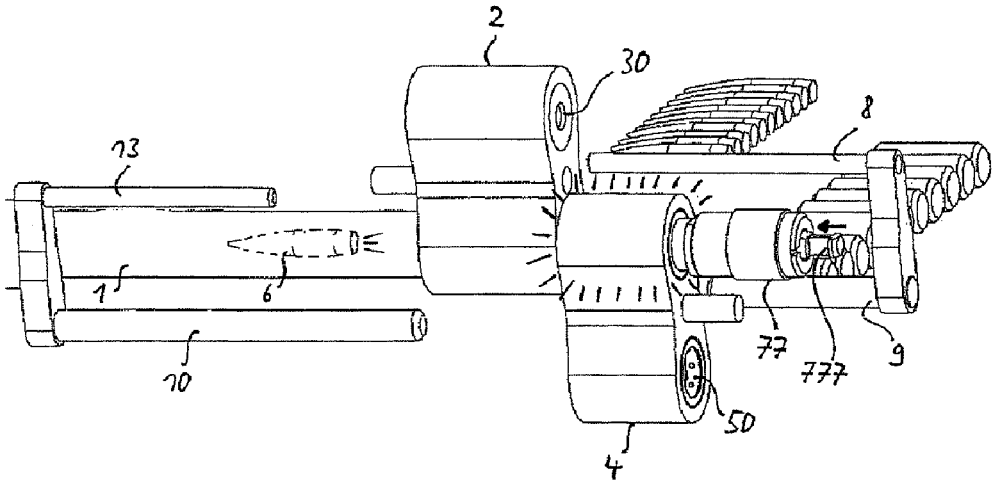

FIGS. 4D and 4E show the transition from the first position to a second position, the firing position, as is illustrated in FIGS. 4F and 4G. In the firing position, the chamber 3 in the projectile holder 2 and the chamber 5 in the propellant charge holder 4 are aligned with the weapon barrel 1. The transition between the first position and the second position is achieved by rotating the projectile holder 2 and the propellant charge holder 4, preferably in opposite directions, about their respective rotation axes X, Y. In the firing position, the end surfaces of the weapon barrel 1, of the projectile holder 2, of the propellant charge holder 4 and of the firing bolt device 77 preferably form a seal with one another, in order to ensure the necessary pressure development on firing of the propellant charge 7. During the rotation phase, as illustrated in FIGS. 4D and 4E, the insertion devices 8, 9 are preferably not moved or are at most pulled back slightly from the maximum insertion position in FIG. 4C, in order to ensure undisturbed rotation of the projectile holder 2 and of the propellant charge holder 4.

In FIG. 4G, the firing bolt device 77 is operated in the firing position. In the process, the firing bolt 777 strikes the propellant charge body 7 which is located in the chamber 5, and possibly also a firing cap which is fitted to the propellant charge 7. The propellant charge 7 then explodes in the chamber 5 in the propellant charge holder 4, and accelerates the projectile 6, which is located in the chamber 3 and is accelerated through the weapon barrel 1 in the direction of the target.

Figure 4H:
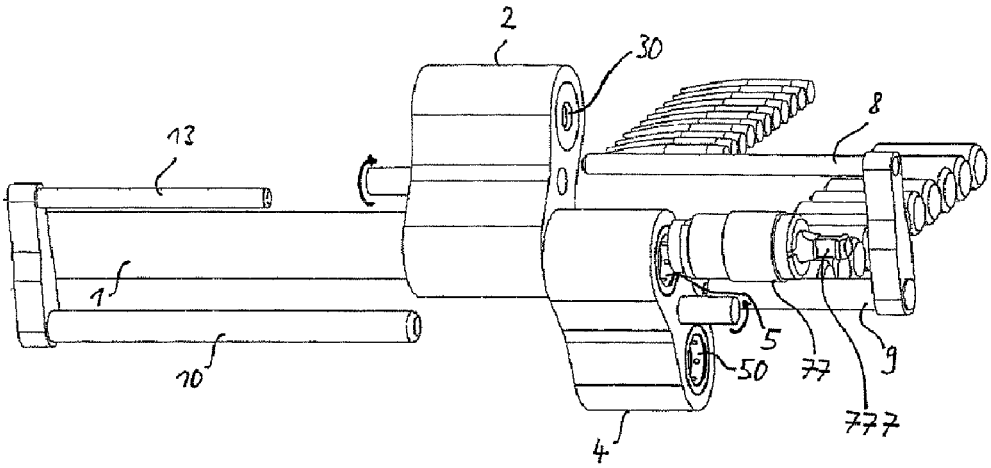
Figure 4I:
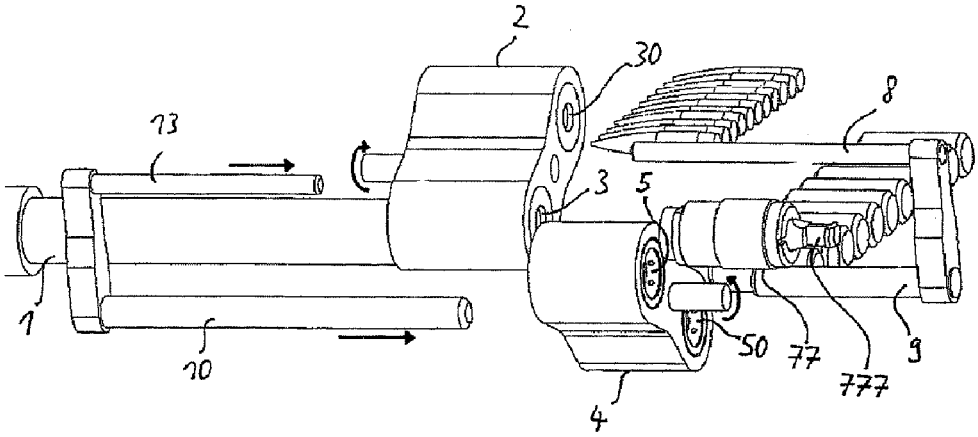
Figure 4J:
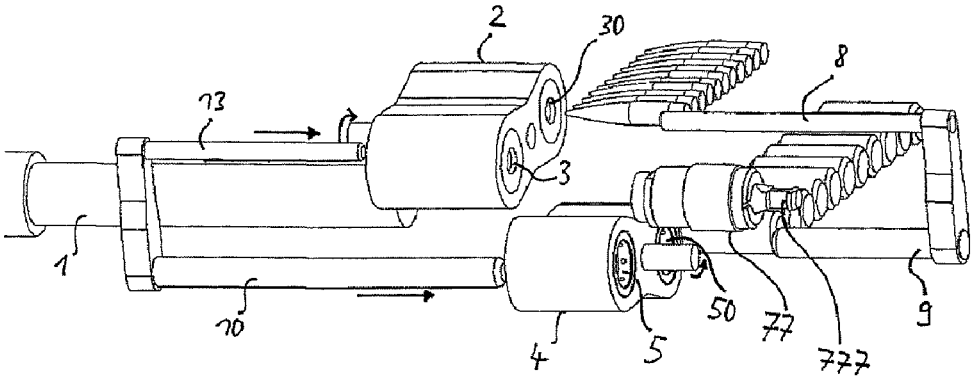
Figure 4K:
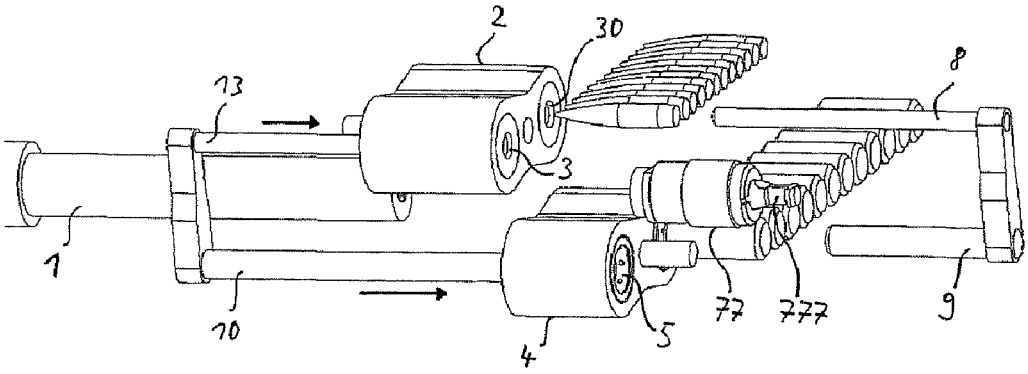
Figure 4L:
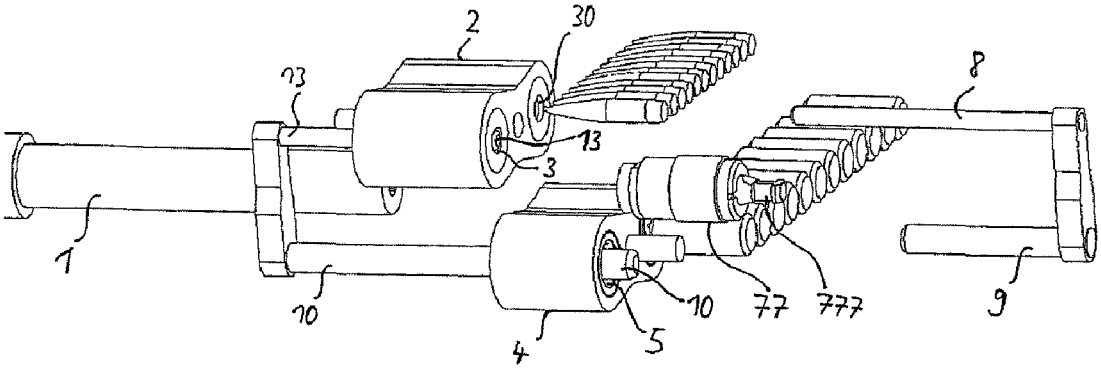

FIGS. 4H to 4J show the transition from the second position to a third position, the unloading position, as is illustrated in FIGS. 4K and 4L. The transition from the second position to the third position once again takes place by rotation of the projectile holder 2 and of the propellant charge holder 4 about the associated respective axis X or Y. In the unloading position, the ejection devices 13, 10 in the form of ejection pins can be activated, and move into the chambers 3 and 4, which are still filled shortly before this. The ejection devices 13, 10 are preferably always activated in this third position, that is to say even when the shot previously successfully fired in the firing position, and the chambers 3, 5 have been emptied. This allows reliable disturbance-free operation independently of the success or failure of the previous firing attempt. The ejection devices 13, 10 are preferably coupled to one another. This has the advantage that this makes it possible to synchronize the ejection process in the projectile chamber 3 and in the propellant charge chamber 5 in a simple manner. Furthermore, in particular, it is also useful to insert the ejection device 10 into the propellant charge chamber 5 even when the propellant charge 7 has previously been fired correctly, to be precise as a cleaning function for the propellant charge chamber 5. This is because combustion residues from the propellant charge 7 that has been fired can be removed from the propellant charge holder 5 in particular by an appropriate configuration of the end surface of the ejection device 10 (for example with scrapers or brushes).

Figure 5A:
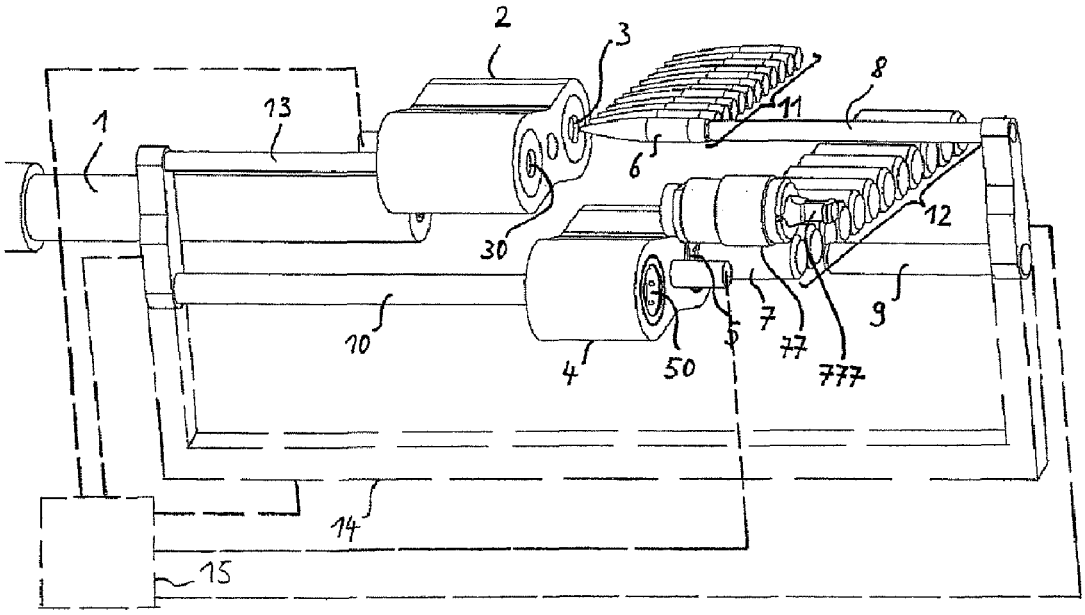
FIGS. 5A-5L show a plurality of successive instantaneous instances in time of one preferred embodiment of the weapon system according to the invention, in order to illustrate the functional process during a disturbed cycle (with failures to fire).
Figure 5B:
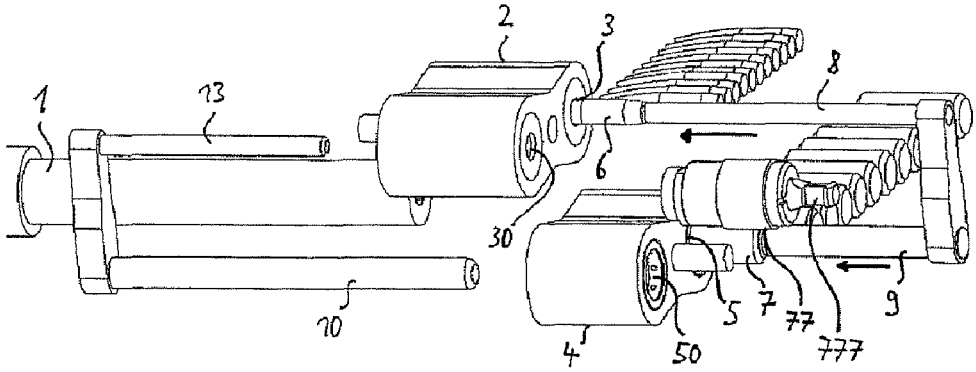
Figure 5C:
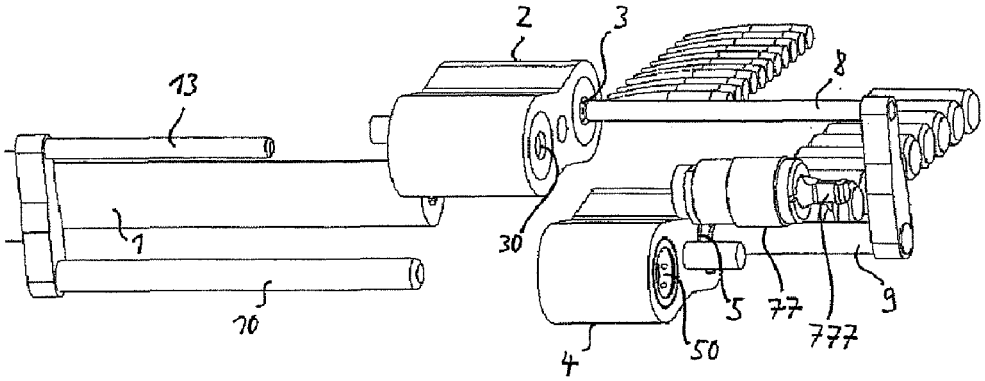
Figure 5D:
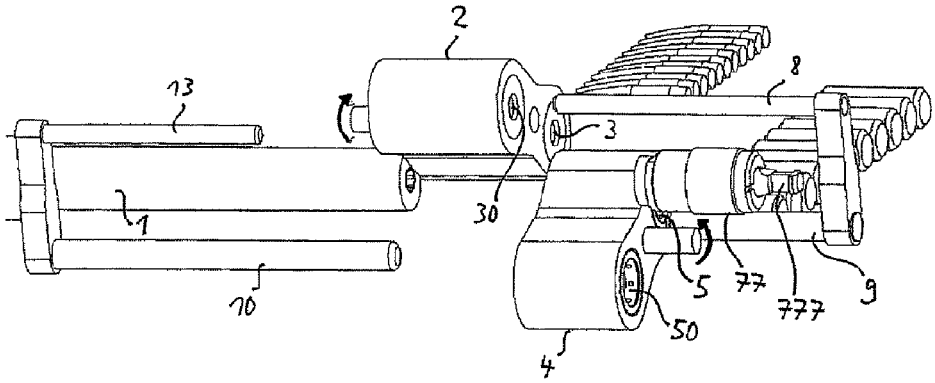
Figure 5E:
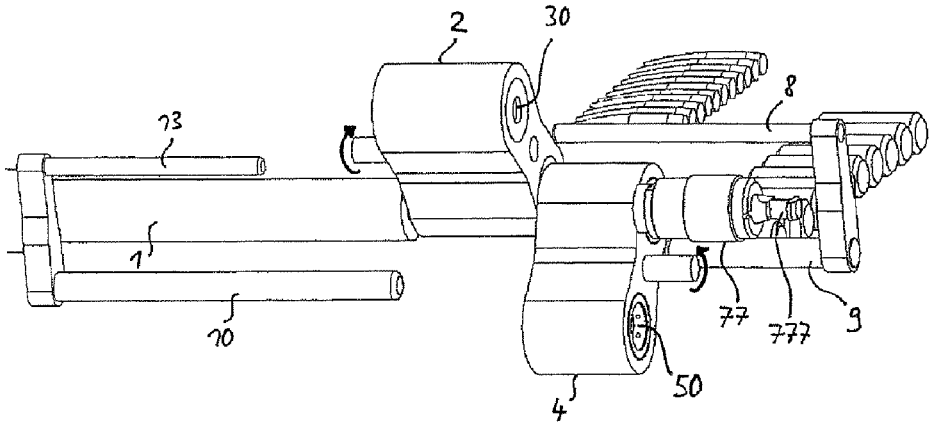
Figure 5F:
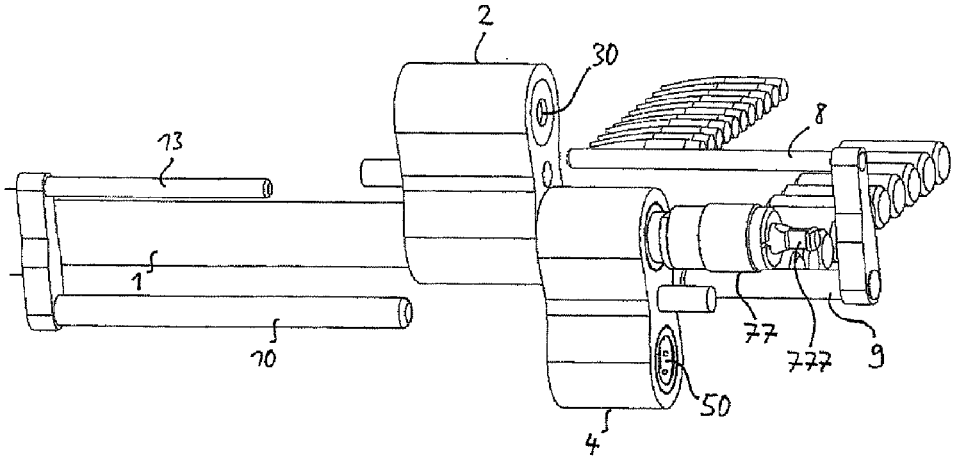

The disturbed functional process (with a failure to fire) for the preferred embodiment of the weapon system will now be explained with reference to FIGS. 5A to 5L. This functional process in FIGS. 5A to 5F is identical to the disturbance-free functional process as illustrated in FIGS. 4A to 4F. In order to avoid repetitions, the explanations relating to FIGS. 4A to 4F will be referred to in their entirety at this point for the explanation relating to FIGS. 5A to 5F. FIG. 5A still shows the optional use of a synchronization means 15, in a form that is representative of all the other figures, by means of which the respective ejection device 10, 13 and/or respective insertion device 8, 9 can be operated as a function of the rotational movement and/or of the angular position of the projectile holder 2 and/or of the propellant charge holder 4. The synchronization means 15 preferably act on the rotating shafts of the projectile holder 2 and of the propellant charge holder 4, and on the insertion devices 8, 9 and the ejection devices 10, 13. If the insertion devices 8 and 9 are coupled, the synchronization means 15 can also act on this coupling. If the ejection devices 10, 13 are coupled, the synchronization means 15 can also act on this coupling. FIG. 5A furthermore also shows the option of coupling the insertion devices 8, 9 to the ejection devices 10, 13. This coupling 14 is preferably linked to the coupling between the insertion devices 8 and 9 and the coupling between the ejection devices 10 and 13. When using a coupling 14 such as this, the synchronization means 15 can also act directly on this coupling 14. The coupling 14 results in a movement of the insertion devices 8, 9 toward the projectile holder 2 and the propellant charge holder 4 being linked to a movement, preferably by the same amount, of the ejection devices 10, 13 away from the projectile holder 2 and the propellant charge holder 4. Furthermore, the coupling 14 results in a movement of the insertion devices 8, 9 away from the projectile holder 2 and the propellant charge holder 4 being linked to a movement, preferably of the same magnitude, of the ejection devices 10, 13 toward the projectile holder 2 and the propellant charge holder 4. The coupling 14 need not necessarily be rigid. A rigid coupling 14 represents merely the simplest embodiment of a coupling such as this. In fact, the coupling 14 can also be provided by a more complex synchronized control process for the insertion devices 8, 9 and the ejection devices 10, 13, which is applied to the insertion devices 8, 9 and the ejection devices 10, 13 by the synchronization means 15. The optional nature of both the synchronization means 15 and of the coupling 14 is expressed by the dashed-line representation of these components. The synchronization means 15 are preferably externally driven, thus advantageously making it possible to ensure that, once a cycle has been started, it will always be completed, and ends with the operation of the ejection device 10 for the propellant charge holders 5, 50, in order in this way to ensure that any propellant charge 7 which may still be located in the propellant charge chambers 5, 50 is ejected in good time.

Figure 5G:
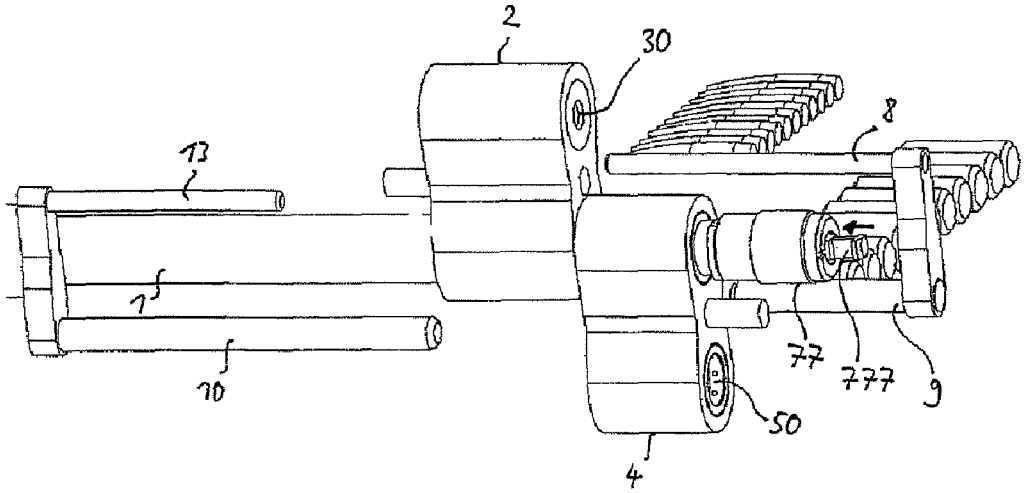

As in FIG. 4G, the firing bolt device 77 is operated in the firing position in FIG. 5G. In this case, the firing bolt 777 strikes the propellant charge body 7 which is located in the chamber 5. In contrast to the disturbance-free operation as in FIG. 4G, the propellant charge 7 does not, however, explode in FIG. 5G, because of a failure to fire. In consequence, the projectile 6 also remains in its chamber 3.

Figure 5H:
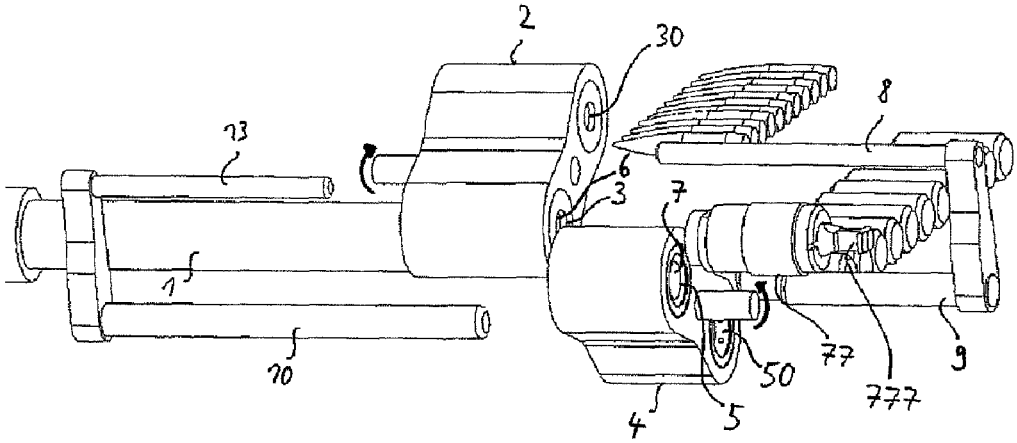
Figure 5I:
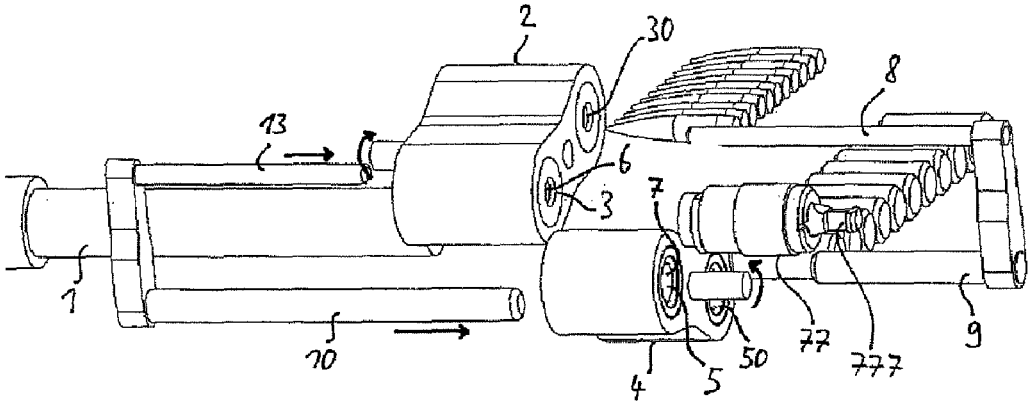
Figure 5J:
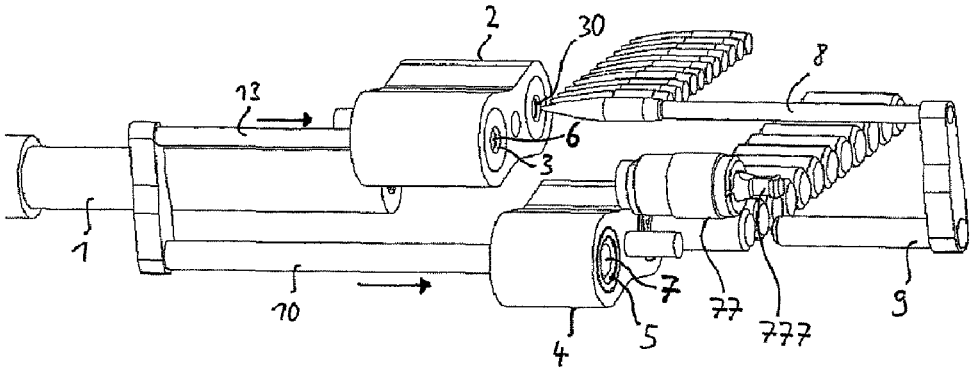
Figure 5K:
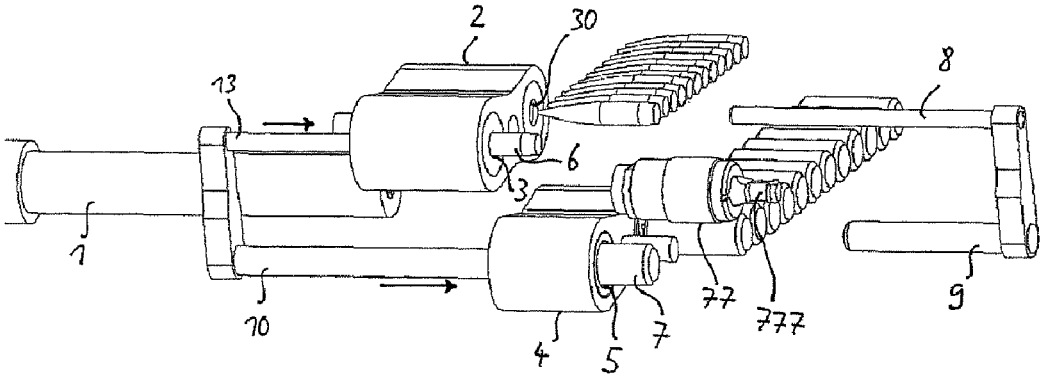
Figure 5L:
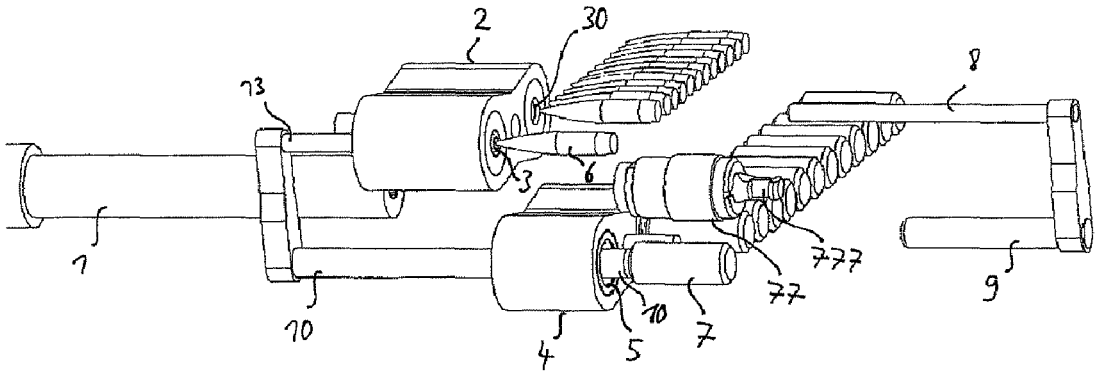

FIGS. 5H to 5J show the transition from the second position to the third position, the unloading position, as is illustrated in FIGS. 5K and 5L. The transition from the second position to the third position takes place by the rotation of the projectile holder 2 and of the propellant charge holder 4 about the associated respective axis X or Y. The ejection devices 13, 10 are now routinely activated in the unloading position. In this case, as is illustrated in FIGS. 5K and 5L, the ejection pins 13, 10 move into the chambers 3, 5 which are filled with the items 6, 7 which have failed to fire, and move the projectile 6, which has remained in the chamber 3, and the propellant charge 7, which has remained in the chamber 5, out of the relevant chambers 3, 5, preferably in the opposite direction to the insertion direction.

A weapon system designed in the sense of FIGS. 4 and 5 advantageously ensures that each cycle, which starts with the loading of a chamber 3, 30 in the projectile holder 2 and a chamber 5, 50 in the propellant charge holder 4, is always carried out completely as far as the unloading in particular of the chambers 5, 50 in the propellant charge holder 4, to be precise irrespective of when (in particular in the case of an automatic weapon) the trigger is released, and also independently of whether, in particular, the most recently loaded propellant charge 7 has or has not failed to fire. This makes it possible to ensure that a propellant charge 7 which is introduced into a chamber 5, 50 in the propellant charge holder 4 (and therefore into the firing chamber) at a specific time in all cases remains in the firing chamber only for a very short time period. This is because the propellant charge 7 which has been loaded is either intentionally fired in the firing position a short time later or, if the propellant charge 7 fails to fire or there is an interruption in the firing sequence, is ejected from its propellant charge chamber 5, 50. This makes it possible to prevent inadvertent firing of a propellant charge 7 with a high probability, in all feasible cases, even if the propellant charge holder 4 has been heated. This represents a major improvement to the safety of the conventional weapon system according to the precharacterizing clause of claim 11.

All features and advantages which have been described in conjunction with the subject matter of claim 11 and the subject matter of claims 12 to 15, which are dependent on claim 11, can be combined directly with the subject matter of the other independent claim 1 and with the subject matter of claims 2 to 10, which are dependent on claim 1, as well. A combination such as this is also, in particular, suggested by the identical wording of the precharacterizing clauses of the two independent claims 1 and 11. A combination such as this makes it possible to combine the advantages of both embodiments in an advantageous manner in a single weapon system.

Reference signs and figure references in the claims are intended only for illustration purposes and should in no way be understood as a restriction to the scope of protection as is intended by the wording of the claims.

LIST OF REFERENCE SYMBOLS

1 Weapon barrel
2 Projectile holder
3, 30 Chamber (projectile)
4 Propellant charge holder
5, 50 Chamber (propellant charge)
6 Projectile
7 Propellant charge
8 Ram; insertion device (projectile)
9 Ram; insertion device (propellant charge)
10 Ejection pin; ejection device (propellant charge)
11 Loading area (projectiles)
12 Loading area (propellant charges)
13 Ejection pin; ejection device (projectile)
14 Coupling
15 Synchronization means
77 Firing bolt device
777 Firing bolt
X Rotation axis (projectile holder)
Y Rotation axis (propellant charge holder)
A Bore axis (weapon barrel)

The invention claimed is:

1. A weapon system for caseless ammunition, the weapon system comprising:

a weapon barrel having a bore axis;

a projectile holder having individual chambers;

a propellant charge holder having individual chambers, said projectile holder and said propellant charge holder can be moved relative to said weapon barrel to ensure a firing position in which a respective one of said chambers in said projectile holder and a respective one of said chambers in said propellant charge holder are located coaxially with respect to said bore axis of said weapon barrel;

a first ejection device for said projectile holder;

said projectile holder can be moved such that one of said chambers of said projectile holder is disposed in an unloading position in which said first ejection device can be activated for a projectile in said one chamber while, in contrast, another of said chambers of said projectile holder can be reloaded in a movement position of said projectile holder;

a second ejection device for said propellant charge holder; and said propellant charge holder can be moved such that one of said chambers of said propellant charge holder is disposed in an unloading position in which said second ejection device can be activated for a propellant charge in said one chamber of said propellant charge holder while, in contrast, another of said chambers of said propellant charge holder can be reloaded in a movement position of said propellant charge holder.

2. The weapon system according to claim 1, wherein at least one of said first ejection device for said projectile holder or said second ejection device for said propellant charge holder can be activated in any unloading position of said projectile holder or of said propellant charge holder.

3. The weapon system according to claim 1, wherein:

said projectile holder is mounted such that said projectile holder can rotate about an associated projectile holder axis; and said propellant charge holder is mounted such that said propellant charge holder can rotate about an associated propellant charge holder axis, said associated projectile holder axis and said associated propellant charge holder axis are each disposed offset parallel to said bore axis of said weapon barrel.

4. The weapon system according to claim 3, wherein said associated projectile holder axis and said associated propellant charge holder axis are in each case positioned with respect to said bore axis and lie on a common plane together with said bore axis, the common plane runs in a longitudinal direction of said bore axis.

5. The weapon system according to claim 3, wherein said projectile holder and said propellant charge holder rotate in opposite senses.

6. The weapon system according to claim 3, further comprising synchronization means for operating said first and second ejection devices in dependence on at least one of a rotational movement of said projective holder, a rotational movement of said propellant charge holder, an angular position of said projectile holder or an angular position of said propellant charge holder.

7. The weapon system according to claim 1, wherein said projectile holder has at least two of said chambers, and said propellant charge holder has at least two of said chambers.

8. The weapon system according to claim 1, wherein the projectile is ejected from said projectile holder in an opposite direction to a firing direction.

9. The weapon system according to claim 1, wherein the propellant charge is ejected from said propellant charge holder in a firing direction.

10. The weapon system according to claim 1, further comprising insertion devices including a first insertion device and a second insertion device;

wherein said projectile holder can be moved in at least one successive cycle, wherein the cycle contains the following successive positions:

a first position, in which one of said chambers of said projectile holder is disposed in a loading position, in which said first insertion device can be activated in order to insert the projectile into said chamber of said projectile holder;

a second position, in which said chamber of said projectile holder is disposed in the firing position; and a third position, in which said chamber of said projectile holder is disposed in the unloading position, in which said first ejection device can be activated in order to eject the projectile, which may still be located in said chamber of said projectile holder, from said chamber of said projectile holder;

wherein said propellant charge holder can be moved in at least one successive cycle, wherein the cycle contains the following successive positions:

a first position, in which one of said chambers of said propellant charge holder is disposed in a loading position, in which said second insertion device can be activated in order to insert the propellant charge into said chamber of said propellant charge holder;

a second position, in which said chamber of said propellant charge holder is disposed in the firing position; and a third position, in which said chamber of said propellant charge holder is disposed in the unloading position, in which said second ejection device can be activated in order to eject the propellant charge, which may still be located in said chamber of said propellant charge holder, out of said chamber of said propellant charge holder.

11. A weapon system for caseless ammunition, the weapon system, comprising:

a weapon barrel having a bore axis;

a projectile holder having individual chambers;

a propellant charge holder having individual chambers, said projectile holder and said propellant charge holder can be moved relative to said weapon barrel for ensuring a firing position in which one of said chambers of said projectile holder and one of said chambers of said propellant charge holder are disposed coaxially with respect to said bore axis of said weapon barrel;

a first ejection device for said projection holder;

a second ejection device for said propellant charge holder;

insertion devices including a first insertion device and a second insertion device;

said projectile holder can be moved in at least one successive cycle, wherein said cycle contains the following successive positions:

a first position, in which one of said chambers of said projectile holder is disposed in a loading position, in which said first insertion device can be activated in order to insert a projectile into said chamber of said projectile holder;

a second position, in which said chamber of said projectile holder is disposed in the firing position; and a third position, in which said chamber of said projectile holder is disposed in an unloading position, in which said first ejection device can be activated in order to eject the projectile, which may still be located in said chamber of said projectile holder, out of said chamber said projectile holder;

wherein said propellant charge holder can be moved in at least one successive cycle, wherein said cycle contains the following successive positions:

a first position, in which one of said chambers of said propellant charge holder is disposed in a loading position, in which said second insertion device can be activated in order to insert a propellant charge into said chamber of said propellant charge holder;

a second position, in which said chamber of said propellant charge holder is disposed in the firing position; and a third position, in which said chamber of said propellant charge holder is disposed in an unloading position, in which said second ejection device can be activated in order to eject the propellant charge, which may still be located in said chamber of said propellant charge holder, out of said chamber of said propellant charge holder.

12. The weapon system according to claim 11, wherein:

said projectile holder is mounted such that said projectile holder can rotate about an associated projectile holder axis; and said propellant charge holder is mounted such that said propellant charge holder can rotate about an associated propellant charge holder axis, said associated projectile holder axis and said associated propellant charge holder axis are each disposed offset parallel to said bore axis of said weapon barrel.

13. The weapon system according to claim 12, wherein said first and second ejection devices can be operated with a time offset with respect to said insertion devices, such that said first and second ejection devices always enter said chambers only with a time offset with respect to an insertion of said insertion devices after rotation of at least one of said projectile holder or said propellant charge holder through 360°/n from the loading position, that is to say an n-th part of 360°, into the unloading position, where n is a number of said chambers in said projectile holder and a number of said chambers in said propellant charge holder.

14. The weapon system according to claim 12, wherein said first and second ejection devices and said insertion devices are coupled to one another such that a movement of said insertion devices toward said projectile holder and said propellant charge holder is linked to a movement, of a same magnitude, of said first and second ejection devices away from said projectile holder and said propellant charge holder, and in that a movement of said insertion devices away from said projectile holder and said propellant charge holder is linked to a movement, of a same magnitude, of said first and second ejection devices toward said projectile holder and said propellant charge holder.

15. The weapon system according to claim 11, further comprising externally driven synchronization means for operating said first and second ejection devices in dependence on at least one of a rotational movement of said projectile holder, a rotational movement of said propellant charge holder, an angular position of said projectile holder, or an angular position of said propellant charge holder.

* * * * *